US005967420A

United States Patent [19]

Kitabayashi et al.

[11] Patent Number: 5,967,420

[45] Date of Patent: Oct. 19, 1999

[54] NOZZLE ASSEMBLY FOR SPRAYING

[75] Inventors: Seiichi Kitabayashi, Ageo; Naoki Takahashi, Iruma-gun, both of Japan

[73] Assignee: Earth Chemical Co., Ltd., Tokyo, Japan

[21] Appl. No.: 09/000,241

[22] PCT Filed: Jun. 23, 1997

[86] PCT No.: PCT/JP97/02143

§ 371 Date: Feb. 6, 1998

§ 102(e) Date: Feb. 6, 1998

[87] PCT Pub. No.: WO97/49498

PCT Pub. Date: Dec. 31, 1997

[30] Foreign Application Priority Data

Jun. 27, 1996 [JP] Japan ..... 8-200907
Aug. 29, 1996 [JP] Japan ..... 8-263417

[51] Int. Cl.[6] ..... A62C 31/00

[52] U.S. Cl. ..... 239/436; 239/581.1; 137/874

[58] Field of Search ..... 239/436, 437, 239/581.1; 137/874, 876; 251/352

[56] References Cited

U.S. PATENT DOCUMENTS 3,116,856 1/1964 Prussin et al. ..... 239/581.1
4,281,796 8/1981 Fugent et al. ..... 239/581.1
4,398,668 8/1983 Jette ..... 239/581.1
4,850,540 7/1989 Taniguchi ..... 239/581.1
4,989,791 2/1991 Ridenour ..... 251/352

FOREIGN PATENT DOCUMENTS 3-64276 6/1991 Japan .
8-253277 10/1996 Japan .

*Primary Examiner*—Andres Kashnikow
*Attorney, Agent, or Firm*—Armstrong, Westerman, Hattori, McLeland & Naughton

[57] ABSTRACT

A rotatably operable nozzle assembly for spraying provided to an operating member for spraying which has a valve stem engaging hole into which a valve stem of a mounting cap of an upper end of a canister is engaged, wherein a spray port of the spray port member is opened when the nozzle assembly for spraying is hung, while a horizontal holding plate is positioned to be brought into contact with or approach towards a top face of the spray port member in a position for covering the spray port of the spray port member when the nozzle assembly for spraying is rotated by 90 degrees into a horizontal position; and a base portion of the nozzle assembly for spraying has a face suitable for rotation on the side opposite to the spray port, thereby allowing rotation of the operating member for spraying.

3 Claims, 6 Drawing Sheets

NOZZLE ASSEMBLY FOR SPRAYING

TECHNICAL FIELD

The present invention relates to a nozzle assembly for spraying. More particularly, the present invention relates to a nozzle assembly for spraying which can be easily assembled thanks to simple structure thereof and has two types of spray ports with different spray directions, and can prevent leakage from the rotating face. The nozzle assembly for spraying of the present invention has a high versatility because an existing jet port of a valve stem can be used.

BACKGROUND ART

As shown in, for example, FIGS. 9 and 10, there is conventionally a switchable long nozzle for spraying which comprises a short base pipe 50 to be projected from the external face of a push bottom and a narrow pipe 51 of a required length which is coupled flexibly to the tip face of the pipe 50 (refer to Japanese Examined Utility Model Publication No. 13805/1978). In the nozzle, a circular portion 52 of a larger diameter at the rear end portion of the narrow pipe 51 is rotatably received with its shaft between grasping pieces 53 at the tip of the base pipe 50. In the condition shown in FIG. 9, the content is sprayed from the spray port 54, and in the condition (not shown) where the narrow pipe is rotated by 90 degrees into a horizontal state, the content is sprayed through an inlet port 55 and a passage 56 of the pipe.

In such a nozzle assembly, there is a risk in that the content, which might remain at the spray port 54, after a spraying operation, may be leaked from the spray port 54 when the narrow pipe 51 is rotated into a horizontal state. Further, a tip portion 58 of a nozzle tube 57 is likely to be deformed inwardly due to, for example, engagement error in a pressure insertion of the inclined tip of the nozzle tube 57, since the nozzle tube 57 is merely fitted into a hole of the circular portion 52. In such a case, a gap is generated in the external periphery of the tip portion 58, thereby causing the danger of the passage 56 being communicated with the other passage 59.

An object of the present invention is to provide a nozzle assembly for spraying of a simple structure which can have two types of spray ports with different spray directions. Another object of the present invention is to provide a nozzle assembly for spraying which can prevent fluid from flowing out from a gap of the rotating face.

DISCLOSURE OF THE INVENTION

In accordance with the present invention, there is provided a rotatably operable nozzle assembly for spraying provided for an operating member for spraying which has a valve stem engaging hole into which a valve stem of a mounting cap at an upper end of a canister is engaged, wherein a spray port of a spray port member is opened when the nozzle assembly for spraying is in a vertical position while a horizontal holding plate is positioned to contact with or be approached by a top face of the spray port member in a position for covering the spray port of the spray port member when the nozzle assembly for spraying is rotated by 90 degrees into a horizontal position; and a base portion of the nozzle assembly for spraying has a face suitable for rotation on the side opposite to the spray port, thereby allowing rotation of the operating member for spraying.

In accordance with the present invention, there is also provided a rotatably operable nozzle assembly for spraying provided for an operating member for spraying which has a valve stem engaging hole into which a valve stem of a mounting cap at an upper end of a canister is engaged, wherein an internal cylindrical body for forming a passage in a base portion of the nozzle assembly for spraying is provided and a cylindrical portion of a spray port member is fitted into a tip of the internal cylindrical body; a spray port of the spray port member is opened when the nozzle assembly for spraying is in a vertical position, while a horizontal holding plate is positioned to contact with or be approached by a top face of the spray port member in a position for covering the spray port of the spray port member when the nozzle assembly for spraying is rotated by 90 degrees into a horizontal position; and a base portion of the nozzle assembly for spraying having a face suitable for rotation on the side opposite to the spray port, thereby allowing rotation of the operating member for spraying.

In accordance with the present invention, there is further provided a rotatably operable nozzle assembly for spraying provided for an operating member for spraying which has a valve stem engaging hole into which a valve stem of a mounting cap at an upper end of a canister is engaged, wherein a spray port of a spray port member is opened when the nozzle assembly for spraying is in a vertical position while a horizontal holding plate is positioned to contact with or be approached by a top face of the spray port member in a position for covering the spray port of the spray port member when the nozzle assembly for spraying is rotated by 90 degrees into a horizontal position; a base portion of the nozzle assembly for spraying has a face suitable for rotation on the side opposite to the spray port; and an elastic sealing member is positioned so as to facingly contact with the face, thereby allowing rotation of the operating member for spraying.

BEST MODE FOR CARRYING OUT THE INVENTION

The present invention relates to a nozzle assembly for spraying, wherein a rotatably operable spraying nozzle assembly is provided for an operating member for spraying which has a valve stem engaging hole into which a valve stem of a mounting cap at an upper end of a canister is engaged. The spray port of a spray port member is opened when the nozzle assembly for spraying is in a vertical position while a horizontal holding plate is positioned to contact with or be approached by the top face of the spray port member in a position for covering the spray port of the spray port member when the nozzle assembly for spraying is rotated by 90 degrees into a horizontal position. The base portion of the nozzle assembly for spraying has a face suitable for rotation on the side opposite to the spray port, which enables the nozzle assembly to be rotatably operated on the operating member for spraying. A cylindrical portion of the spray port member is fitted into the external of the tip of the internal cylindrical body which forms a passage in the base portion of the nozzle assembly for spraying, so that it is difficult to detach the spray port member from the base portion. The spray port of the spray port member is opened to allow spraying when the nozzle assembly for spraying is in a vertical position. When the nozzle assembly for spraying is rotated by 90 degrees into a horizontal position, the horizontal holding plate contacts or is approached by the top face of the spray port member in a condition for closing the spray port of the spray port member. Since an opening provided in the base portion of the nozzle assembly for spraying is communicated with the passage, the spraying operation can be conducted from the tip of the nozzle assembly for spraying.

Since the opposite side of the spray port is made as a face suitable for rotation, an elastic sealing member is positioned so as to contact the face, and a long cylindrical structure for spraying is rotatably projected from the operating member for spraying, any leakage from the communication path between the opening provided in the base portion and the passage can be eliminated.

The nozzle assembly for spraying of the present invention includes, for example, a long nozzle assembly for spraying and a spiral tube nozzle assembly for spraying. The two types of nozzle assemblies for spraying will be described respectively hereinbelow with reference to Embodiment 1 and Embodiment 2.

EMBODIMENT 1

Figure 1:
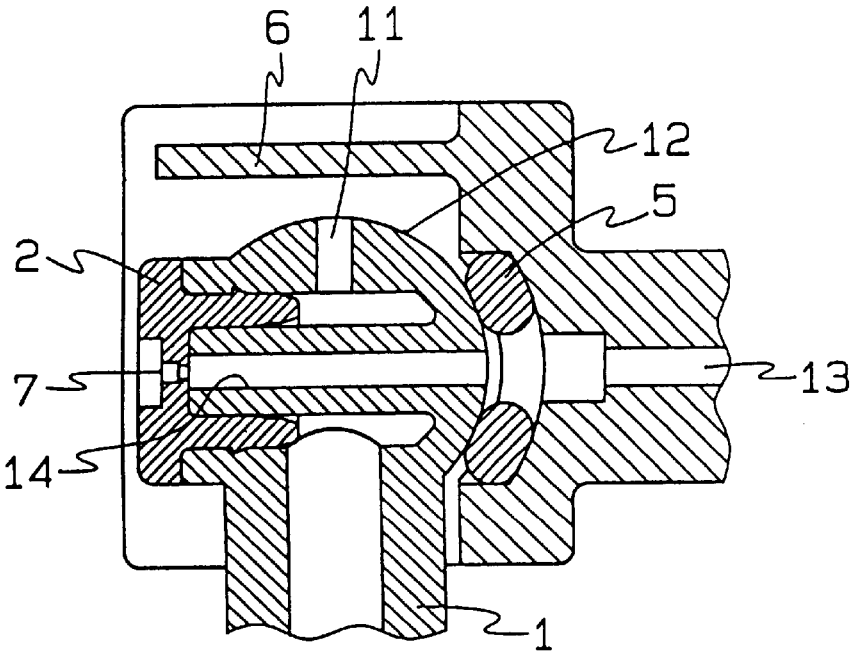
FIG. 1 is a longitudinal sectional view showing a condition capable of spraying from a spray port of a spray port member in the nozzle assembly for spraying.
Figure 2:
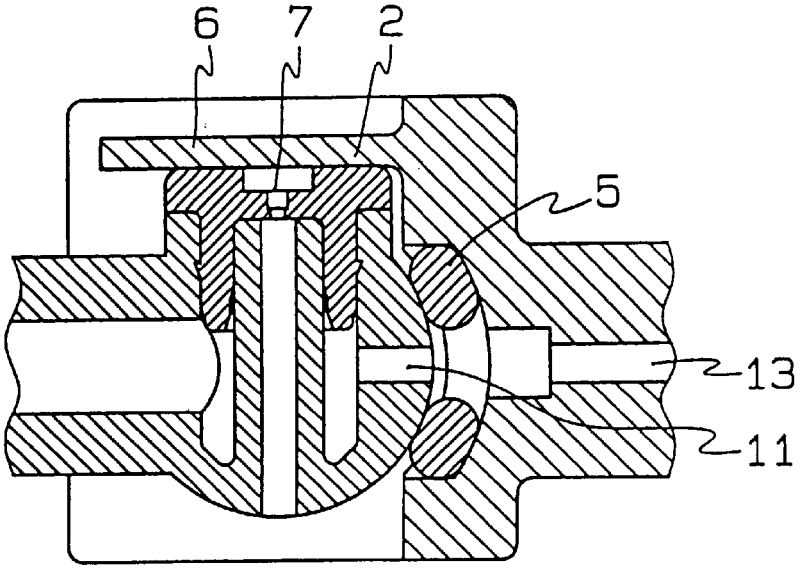
FIG. 2 is a longitudinal sectional view showing a condition capable of spraying from the tip portion of the nozzle assembly for spraying, with a spray port of a spray port member of the nozzle assembly for spraying being rotated by 90 degrees and is covered by a horizontal holding plate.
Figure 3:
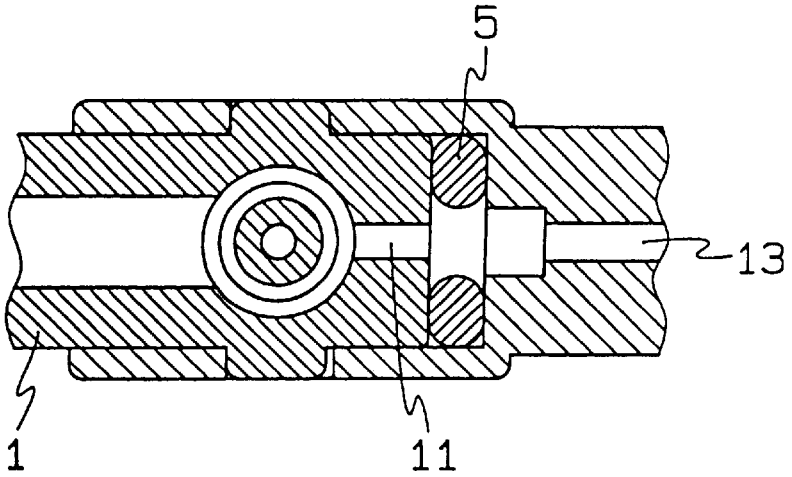
FIG. 3 is a cross sectional view showing a condition where a rotating shaft portion functioning as a rotating center in FIG. 2 is supported by both side walls.
Figure 4:
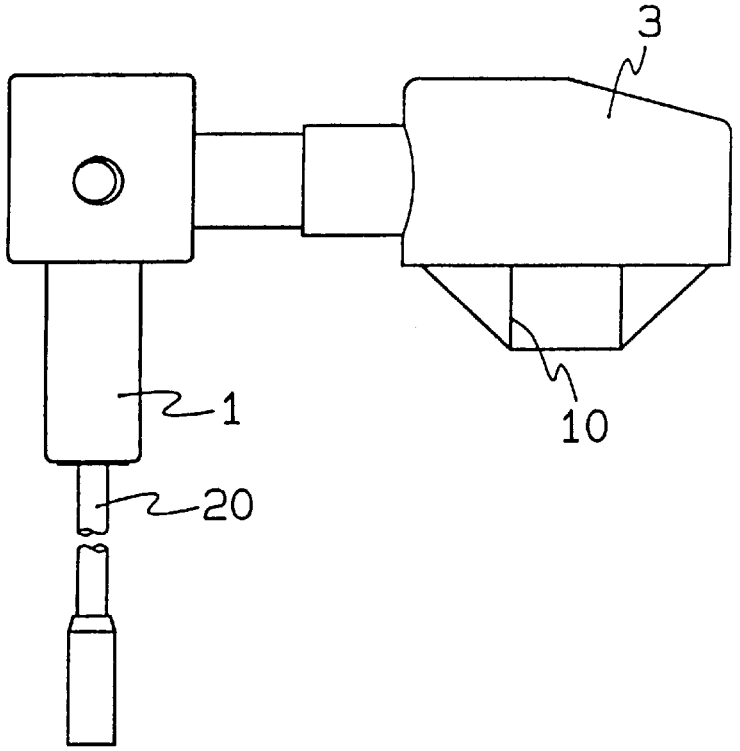
FIG. 4 is a schematic view showing a condition capable of spraying from a spray port of a spray port member in the long nozzle assembly for spraying, wherein a tip portion of a long nozzle assembly for spraying is hung or in a vertical position.
Figure 5:
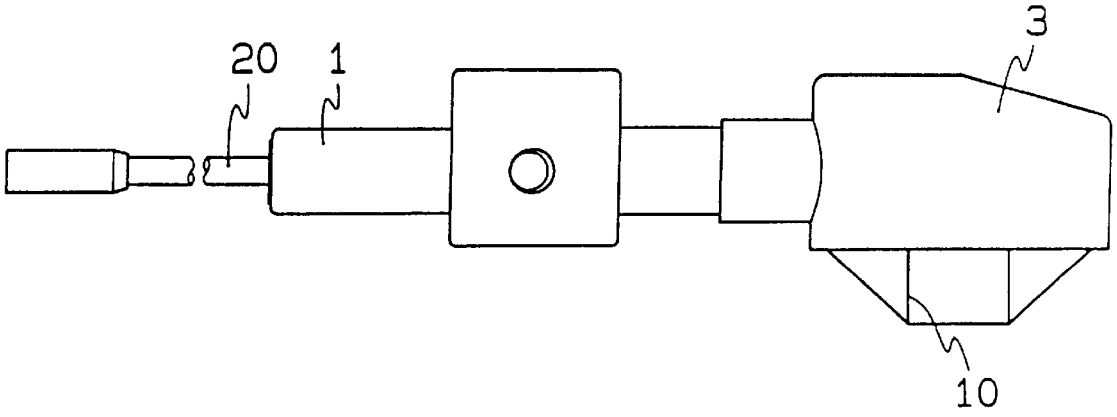
FIG. 5 is a schematic view showing a condition capable of spraying from a tip portion of the long nozzle assembly for spraying, with a spray port of a spray port member of the nozzle assembly for spraying being rotated by 90 degrees and is covered by a horizontal holding plate.
Figure 6:
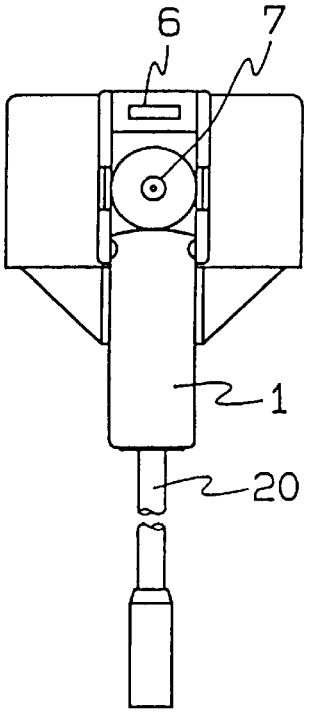
FIG. 6 is a schematic view seen from the side of a spray port in a spray port member of the long nozzle assembly for spraying, and showing a condition capable of spraying from the spray port in the spray port member of the long nozzle assembly for spraying.

In the present Embodiment, as shown in FIGS. 1 through 6, a long nozzle assembly for spraying is formed by connecting a long nozzle 20 for spraying with a nozzle assembly 1 for spraying. A rotatably operable nozzle assembly 1 for spraying is provided for an operating member 3 for spraying which has a valve stem engaging hole 10 into which a valve stem of a mounting cap at an upper end of a canister fits. The spray port 7 of the spray port member 2 is opened when the long nozzle assembly 1 for spraying is in a vertical position. On the other hand, when the long nozzle assembly for spraying 1 is rotated by 90 degrees into a horizontal position, a horizontal holding plate 6 is positioned to contact with or be approached by the top face of the spray port member 2 in a position for covering the spraying port 7 of the spray port member 2. On the side opposite to the spray port 7, the base portion of the long nozzle assembly for spraying is formed as a spherical face 12 or the like suitable for rotation. An elastic sealing member 5 such as an O ring or packing is provided, as occasion demands, at a position where it contacts with the face 12. A cylindrical portion of the spray port member 2 is fitted into the tip of the internal cylindrical body 14 which forms a passage in the base portion of the long nozzle assembly for spraying, so that the spray port member is difficult to detach from the base portion. The spraying operation can be conducted with the spray port 7 of the spray port member 2 being opened in a condition where the long nozzle assembly for spraying is in a vertical position. When the long nozzle assembly for spraying is rotated by 90 degrees into a horizontal position, the horizontal holding plate 6 contacts with or is approached by the spray port member 2 in a position for covering the spray port 7 of the spray port member 2. The opening 11 provided in the base portion of the long nozzle assembly for spraying then communicates with the passage 13, thereby enabling the spraying operation from the tip of the long nozzle assembly for spraying.

EMBODIMENT 2

Figure 7:
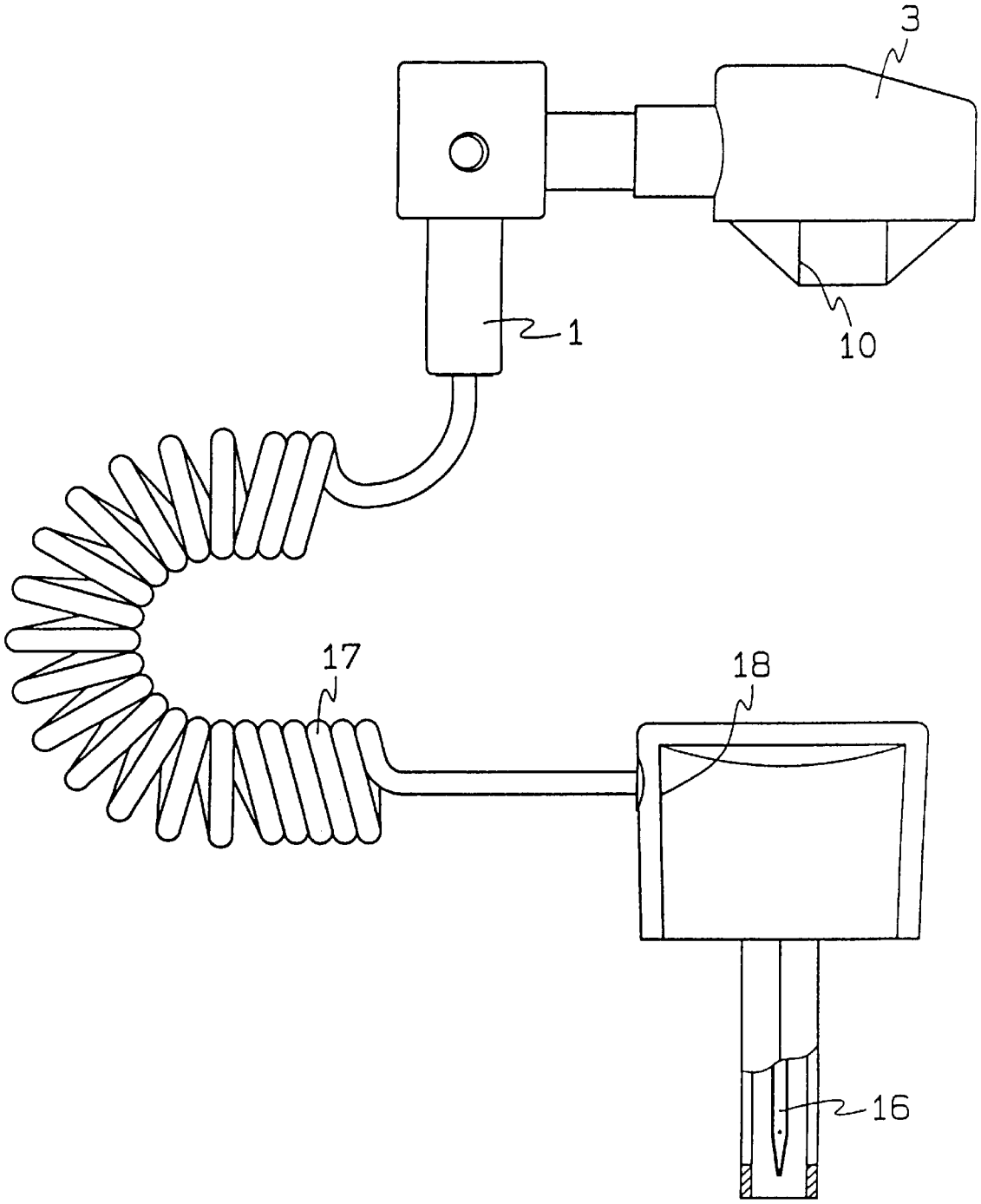
FIG. 7 is a schematic view showing a condition capable for spraying from a spray port of a spray port member in a spiral tube nozzle assembly for spraying.
Figure 8:
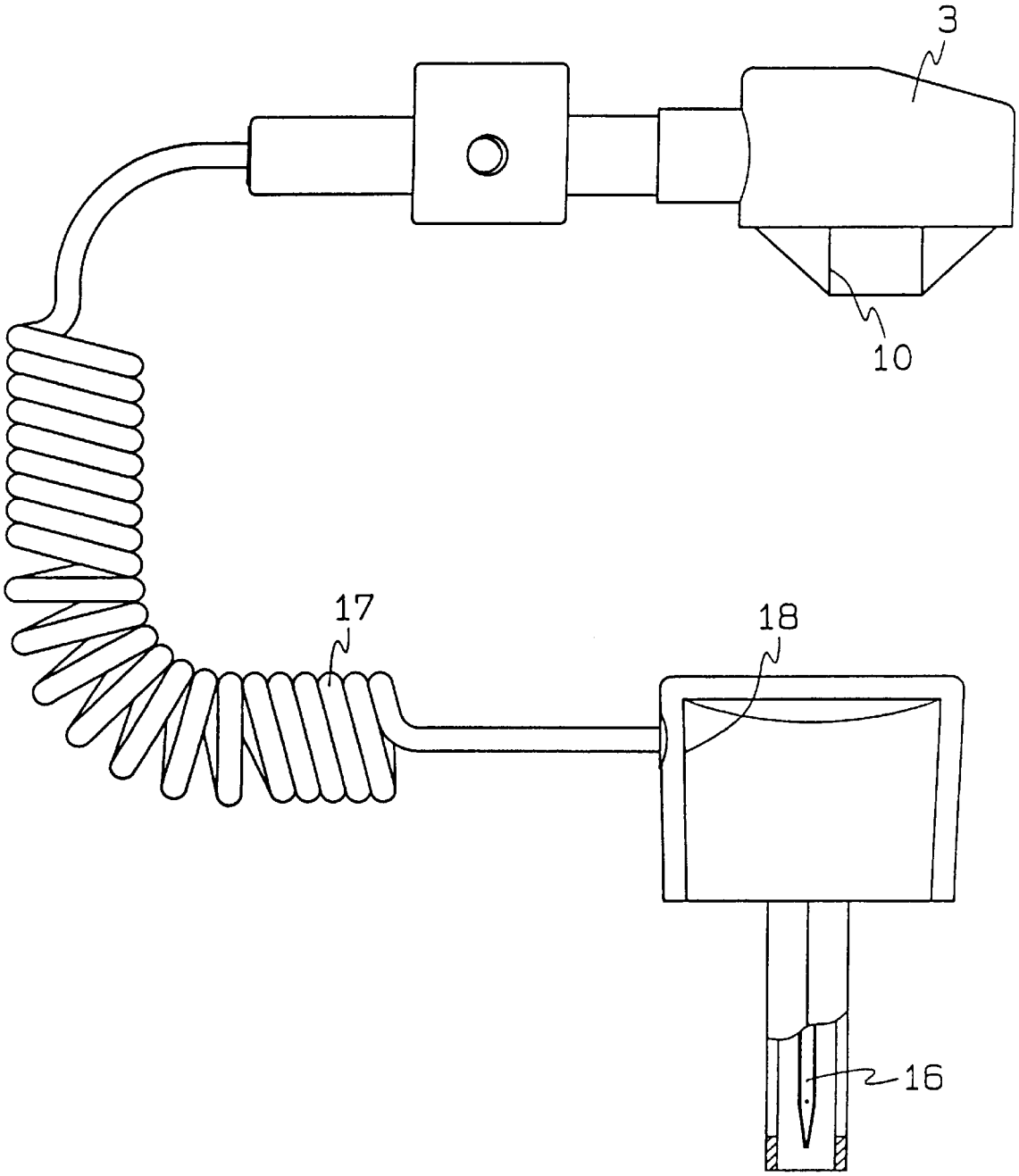
FIG. 8 is a schematic view showing a condition where the content to be sprayed is sprayed from a tip, with a needle-shaped tip portion of the spiral tube nozzle assembly for spraying being inserted into a tatami mat.
Figure 9:
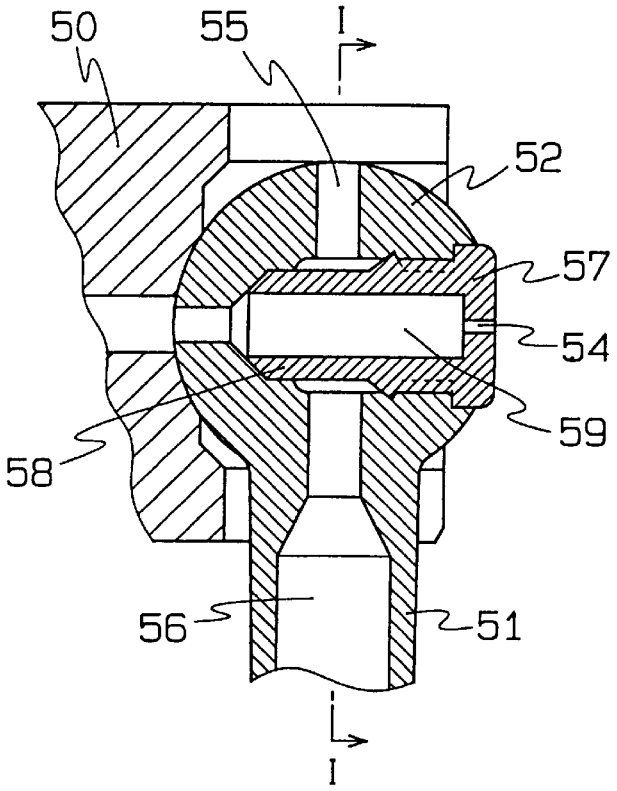
FIG. 9 PRIOR ART
FIG. 9 is an enlarged longitudinal sectional view of a connecting portion between a base pipe and a narrow pipe in the conventional long nozzle.
Figure 10:
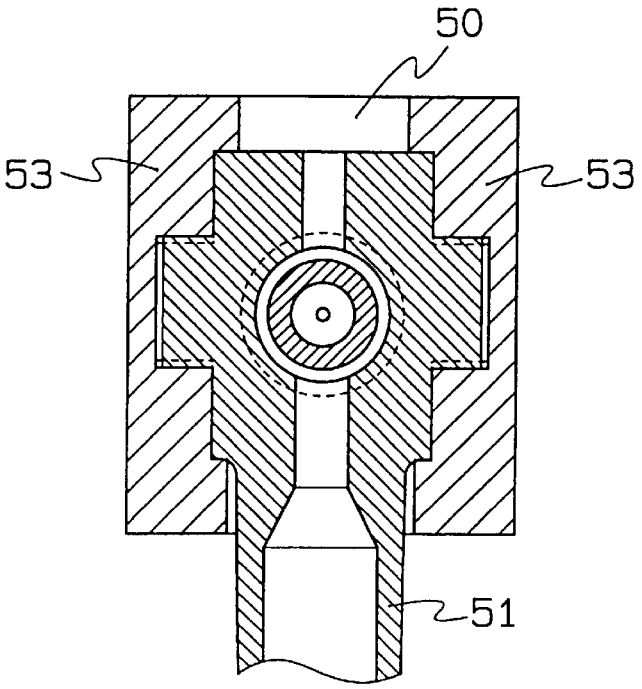
FIG. 10 PRIOR ART
FIG. 10 is a sectional view taken along the line I—I of FIG. 9.

In the present embodiment, as shown in FIGS. 1 through 3, and FIGS. 7 and 8, a spiral tube nozzle assembly for spraying is formed by connecting a spiral tube nozzle 17 for spraying with a nozzle assembly 1 for spraying. A rotatably operable spiral nozzle assembly for spraying is provided for an operating member 3 for spraying which has a valve stem engaging hole 10 into which a valve stem of a mounting cap at an upper end of a canister is engaged. The spray port 7 of the spray port member 2 is opened when the spiral tube nozzle for spraying is in a vertical position. On the other hand, when the spiral tube nozzle assembly for spraying 1 is rotated by 90 degrees into a horizontal position, a horizontal holding plate 6 contacts with or is approached by the top face of the spray port member 2 in a position for covering the spray port 7 of the spray port member 2. Further, on the side opposite to the spray port 7, a base of the nozzle assembly for spraying is formed as a face 12 suitable for rotation, and an elastic sealing member 5 is positioned, as occasion demands, so as to contact with the face 12. Since the opposite side of the spray port 7 is made as a spherical face 12 suitable for rotation, an elastic sealing member 5 is provided, as occasion demands, at a position where it contacts the face 12, and a spiral tube nozzle assembly for spraying is rotatably projected from the operating member 3 for spraying, any leakage from the communication path between the opening 11 provided in the base portion and the passage 13 can be eliminated thanks to provision of the elastic sealing member 5.

According to the present invention, a cylindrical portion of the spray port member 2 is fitted into the external of the tip of the internal cylindrical body 14 which forms a passage in the base portion of the nozzle assembly 1 for spraying, so that the spray port member 2 is difficult to detach from the base portion. The spray port 7 of the spray port member 2 is opened to allow spraying when the nozzle assembly for spraying is in a vertical position. When the nozzle assembly 1 for spraying is rotated by 90 degrees into a horizontal position, the horizontal holding plate 6 contacts or is approached by the top face in a position for covering the spray portion 7 of the spray port member 2. Thus, in the case of the long nozzle assembly for spraying, the spraying operation is conducted from the tip thereof, and the spraying operation can be conducted up to a location narrow in width and deep in length. Furthermore, a tip needle-shaped portion 16 of the spiral tube is pierced into a tatami mat in the case of the spiral tube nozzle assembly for spraying, so as to make it possible to spray from the tip thereof.

Since the opposite side of the spray port 7 is formed as a face 12 suitable for rotation, an elastic sealing member 5 is provided at a position where it contacts the face 12, and the nozzle assembly for spraying 1 is rotatably projected from the operating member for spraying 3, any leakage from the communication path between the opening 11 provided in the base portion and the passage 13 can be eliminated.

Furthermore, since the horizontal holding plate 6 contacts or approaches a position for covering the spray port 7 of the spray port member 2 when the nozzle assembly 1 for spraying is rotated by 90 degrees into a horizontal position, leakage is not caused from the spray port 7, with an effect of spraying from the tip of the nozzle assembly 1 for spraying.

Industrial Applicability

A nozzle assembly for spraying of the present invention can be easily assembled thanks to simple structure thereof, has two types of spray ports with different spray directions and prevents leakage from the rotating face. Especially, the spraying operation can be conducted up to a location deep in length in the case of a long nozzle. Further, in the case of a spiral tube nozzle, it is useful as a nozzle assembly wherein the spraying operation can be conducted with a tip needle-shaped portion being pierced into a tatami mat.

We claim:

1. A rotatably operable nozzle assembly, for an operating member for spraying which has a valve stem engaging hole into which a valve stem of a mounting cap at an upper end of a cannister is engaged, comprising:

a spray port member having a spray port, a holding plate, and a base portion on a side opposite said spray port, said spray port being opened when the nozzle assembly is in a vertical position, and said holding plate is positioned to be contacted with or approached by a top face of said spray port member, so as to cover said spray port when the nozzle is rotated by 90 degrees into a horizontal position; and said base portion of the nozzle assembly has a face suitable for rotation, so as to allow rotation thereof for spraying, on the side opposite said spray port.

2. A rotatably operable nozzle assembly, for an operating member for spraying which has a valve stem engaging hole into which a valve stem of a mounting cap at an upper end of a cannister is engaged, comprising:

a spray port member having a spray port, a holding plate, and a base portion on a side opposite said spray port;

an internal cylindrical body, having a tip, forming a passage in said base portion;

a cylindrical portion of said spray portion fitted into said tip of said internal cylindrical body;

said spray port being opening when the nozzle assembly is in a vertical position, and said holding plate is positioned to be contacted with or approached by a top face of said spray port member, so as to cover said spray port when the nozzle is rotated by 90 degrees into a horizontal position; and said base portion of the nozzle assembly has a face suitable for rotation, so as to allow rotation thereof for spraying on the side opposite said spray port.

3. A rotatably operable nozzle assembly, for an operating member for spraying which has a valve stem engaging hole into which a valve stem of a mounting cap at an upper end of a cannister is engaged, comprising:

a spray port member having a spray port, a holding plate, and a base portion on a side opposite said spray port, said spray port being opened when the nozzle assembly is in a vertical position, and said holding plate is positioned to be contacted with or approached by a top face of said spray port member, so as to cover said spray port when the nozzle is rotated by 90 degrees into a horizontal position; and said base portion of the nozzle assembly has a face suitable for rotation thereof for spraying on the side opposite said spray port; and an elastic sealing member facingly contacting said face, so as to allow rotation thereof for spraying.

* * * * *